US010816245B2

(12) United States Patent
Prins et al.

(10) Patent No.: US 10,816,245 B2
(45) Date of Patent: Oct. 27, 2020

(54) VAPOUR COMPRESSION SYSTEM WITH AT LEAST TWO EVAPORATOR GROUPS

(71) Applicant: Danfoss A/S, Nordborg (DK)

(72) Inventors: Jan Prins, Havnbjerg (DK); Frede Schmidt, Sønderborg (DK); Kenneth Bank Madsen, Ry (DK); Kristian Fredslund, Haderslev (DK)

(73) Assignee: DANFOSS A/S, Nordborg (DK)

( * ) Notice: Subject to any disclaimer, the term of this patent is extended or adjusted under 35 U.S.C. 154(b) by 47 days.

(21) Appl. No.: 15/752,042

(22) PCT Filed: Jul. 1, 2016

(86) PCT No.: PCT/EP2016/065575
§ 371 (c)(1),
(2) Date: Feb. 12, 2018

(87) PCT Pub. No.: WO2017/029011
PCT Pub. Date: Feb. 23, 2017

(65) Prior Publication Data

US 2018/0231284 A1 Aug. 16, 2018

(30) Foreign Application Priority Data

Aug. 14, 2015 (DK) ..... 2015 00473

(51) Int. Cl.
*F25B 41/06* (2006.01)
*F25B 49/02* (2006.01)
(Continued)

(52) U.S. Cl.
CPC ..... *F25B 41/062* (2013.01); *F22B 3/045* (2013.01); *F25B 41/00* (2013.01); *F25B 43/006* (2013.01);
(Continued)

(58) Field of Classification Search
CPC ..... F25B 2341/0015; F25B 41/062; F25B 41/00; F25B 43/006; F25B 2341/0012; F25B 2341/0013; F25B 2400/0016
See application file for complete search history.

(56) References Cited

U.S. PATENT DOCUMENTS 1,836,318 A 12/1931 Gay
3,788,394 A 1/1974 Derragon
(Continued)

FOREIGN PATENT DOCUMENTS

CN 1309279 A 8/2001
CN 1374491 A 10/2002
(Continued)

OTHER PUBLICATIONS

US 5,385,033 A, 01/1995, Sandofsky et al. (withdrawn)
(Continued)

*Primary Examiner* — Elizabeth J Martin
(74) *Attorney, Agent, or Firm* — McCormick, Paulding & Huber PLLC

(57) ABSTRACT

A method for controlling a vapour compression system in an energy efficient and stable manner, the vapour compression system (1) including at least two evaporator groups (5*a*, 5*b*, 5*c*), each evaporator group (5*a*, 5*b*, 5*c*) including an ejector unit (7*a*, 7*b*, 7*c*), at least one evaporator (9*a*, 9*b*, 9*c*) and a flow control device (8*a*, 8*b*, 8*c*) controlling a flow of refrigerant to the at least one evaporator (9*a*, 9*b*, 9*c*). For each evaporator group (5*a*, 5*b*, 5*c*) the outlet of the evaporator (9*a*, 9*b*, 9*c*) is connected to a secondary inlet (12*a*, 12*b*, 12*c*) of the corresponding ejector unit (7*a*, 7*b*, 7*c*).

16 Claims, 6 Drawing Sheets

(51) Int. Cl.

| | |
|---|---|
| ***F25B 41/00*** | (2006.01) |
| ***F22B 3/04*** | (2006.01) |
| ***F25B 43/00*** | (2006.01) |

(52) U.S. Cl.

CPC ..... *F25B 49/02* (2013.01); *F25B 49/027* (2013.01); *F25B 2341/0012* (2013.01); *F25B 2341/0013* (2013.01); *F25B 2341/0015* (2013.01); *F25B 2400/0751* (2013.01)

(56) References Cited

U.S. PATENT DOCUMENTS

| | | | | |
|---|---|---|---|---|
| 4,067,203 | A | 1/1978 | Behr | |
| 4,219,079 | A | 8/1980 | Sumitomo | |
| 4,301,662 | A | 11/1981 | Whitnah | |
| 4,420,373 | A | 12/1983 | Egosi | |
| 4,522,037 | A | 6/1985 | Ares et al. | |
| 4,573,327 | A | 3/1986 | Cochran | |
| 4,646,821 | A | 3/1987 | Almqvist et al. | |
| 5,024,061 | A | 6/1991 | Pfeil, Jr. et al. | |
| 5,226,320 | A | 7/1993 | Dages et al. | |
| 5,553,457 | A | 9/1996 | Reznikov | |
| 5,887,650 | A | 3/1999 | Yang | |
| 6,305,187 | B1 | 10/2001 | Tsuboe et al. | |
| 6,698,221 | B1 | 3/2004 | You | |
| 6,786,056 | B2 | 9/2004 | Bash et al. | |
| 6,823,691 | B2 | 11/2004 | Ohta | |
| 7,178,359 | B2 | 2/2007 | Oshitani et al. | |
| 7,334,427 | B2 | 2/2008 | Ozaki et al. | |
| 7,389,648 | B2 | 6/2008 | Concha et al. | |
| 7,844,366 | B2 | 11/2010 | Singh | |
| 8,887,524 | B2 | 11/2014 | Mihara | |
| 8,991,201 | B2 | 3/2015 | Ikegami et al. | |
| 9,217,590 | B2 | 12/2015 | Cogswell et al. | |
| 9,752,801 | B2 | 9/2017 | Verma et al. | |
| 2001/0025499 | A1 | 10/2001 | Takeuchi et al. | |
| 2002/0124592 | A1 | 9/2002 | Takeuchi et al. | |
| 2003/0145613 | A1 | 8/2003 | Sakai et al. | |
| 2003/0209032 | A1 | 11/2003 | Ohta | |
| 2004/0003608 | A1 | 1/2004 | Takeuchi et al. | |
| 2004/0003615 | A1 | 1/2004 | Yamaguchi | |
| 2004/0007014 | A1 | 1/2004 | Takeuchi et al. | |
| 2004/0011065 | A1 | 1/2004 | Takeuchi et al. | |
| 2004/0040340 | A1 | 3/2004 | Takeuchi et al. | |
| 2004/0055326 | A1* | 3/2004 | Ikegami ..... | B60H 1/3214 62/500 |
| 2004/0060316 | A1 | 4/2004 | Ito et al. | |
| 2004/0069011 | A1 | 4/2004 | Nishida et al. | |
| 2004/0079102 | A1 | 4/2004 | Umebayashi et al. | |
| 2004/0103685 | A1 | 6/2004 | Yamaguchi et al. | |
| 2004/0123624 | A1 | 7/2004 | Ohta et al. | |
| 2004/0211199 | A1 | 10/2004 | Ozaki et al. | |
| 2004/0255602 | A1 | 12/2004 | Sato et al. | |
| 2004/0255612 | A1 | 12/2004 | Nishijima et al. | |
| 2004/0255613 | A1 | 12/2004 | Choi et al. | |
| 2004/0261448 | A1 | 12/2004 | Nishijima et al. | |
| 2006/0236708 | A1 | 10/2006 | Mizuno et al. | |
| 2006/0254308 | A1 | 11/2006 | Yokoyama et al. | |
| 2006/0277932 | A1 | 12/2006 | Otake et al. | |
| 2008/0196873 | A1 | 8/2008 | Svensson | |
| 2009/0071177 | A1 | 3/2009 | Unezaki et al. | |
| 2009/0241569 | A1 | 10/2009 | Okada et al. | |
| 2009/0266093 | A1 | 10/2009 | Aoki | |
| 2010/0192607 | A1 | 8/2010 | Unezaki et al. | |
| 2010/0206539 | A1 | 8/2010 | Kim et al. | |
| 2010/0319393 | A1 | 12/2010 | Ikegami et al. | |
| 2011/0005268 | A1 | 1/2011 | Oshitani et al. | |
| 2011/0023515 | A1 | 2/2011 | Kopko et al. | |
| 2011/0041523 | A1 | 2/2011 | Taras et al. | |
| 2011/0197606 | A1 | 8/2011 | Zimmermann et al. | |
| 2011/0219803 | A1 | 9/2011 | Park et al. | |
| 2011/0239667 | A1 | 10/2011 | Won et al. | |
| 2011/0256005 | A1 | 10/2011 | Takeoka et al. | |
| 2011/0283723 | A1 | 11/2011 | Yakumaru | |
| 2011/0314854 | A1 | 12/2011 | Sata et al. | |
| 2012/0006041 | A1 | 1/2012 | Ikeda et al. | |
| 2012/0060523 | A1 | 3/2012 | Hung | |
| 2012/0151948 | A1 | 6/2012 | Ogata et al. | |
| 2012/0167601 | A1 | 7/2012 | Cogswell et al. | |
| 2012/0180510 | A1 | 7/2012 | Okazaki et al. | |
| 2012/0247146 | A1 | 10/2012 | Yamada et al. | |
| 2012/0324911 | A1 | 12/2012 | Shedd | |
| 2013/0042640 | A1 | 2/2013 | Higashiiue et al. | |
| 2013/0111935 | A1 | 5/2013 | Lou et al. | |
| 2013/0111944 | A1 | 5/2013 | Wang et al. | |
| 2013/0125569 | A1 | 5/2013 | Verma et al. | |
| 2013/0174590 | A1 | 7/2013 | Sjoholm et al. | |
| 2013/0251505 | A1 | 9/2013 | Wang et al. | |
| 2014/0208785 | A1 | 7/2014 | Wallace et al. | |
| 2014/0326018 | A1 | 11/2014 | Ignatiev | |
| 2014/0345318 | A1* | 11/2014 | Nagano ..... | F25B 1/06 62/500 |
| 2015/0300706 | A1 | 10/2015 | Awa et al. | |
| 2015/0330691 | A1 | 11/2015 | McSweeney | |
| 2016/0109160 | A1 | 4/2016 | Junge et al. | |
| 2016/0169565 | A1 | 6/2016 | Yokoyama et al. | |
| 2016/0169566 | A1 | 6/2016 | Nakashima et al. | |
| 2016/0186783 | A1* | 6/2016 | Nishijima ..... | F04F 5/20 62/500 |
| 2016/0280041 | A1 | 9/2016 | Suzuki et al. | |
| 2017/0159977 | A1 | 6/2017 | Hellmann | |
| 2017/0321941 | A1 | 11/2017 | Fredslund et al. | |
| 2017/0343245 | A1 | 11/2017 | Fredslund et al. | |
| 2018/0023850 | A1 | 1/2018 | Chaudhry et al. | |
| 2018/0066872 | A1 | 3/2018 | Hellmann | |
| 2018/0119997 | A1 | 5/2018 | Siegert et al. | |
| 2018/0142927 | A1* | 5/2018 | Hellmann ..... | F25B 1/10 |
| 2018/0274821 | A1 | 9/2018 | Lee et al. | |
| 2018/0283750 | A1 | 10/2018 | Prins et al. | |
| 2018/0320944 | A1 | 11/2018 | Prins et al. | |

FOREIGN PATENT DOCUMENTS

| | | | |
|---|---|---|---|
| CN | 1776324 | A | 5/2006 |
| CN | 1892150 | A | 1/2007 |
| CN | 101329115 | A | 12/2008 |
| CN | 101922823 | A | 12/2010 |
| CN | 102128508 | A | 7/2011 |
| CN | 201992750 | U | 9/2011 |
| CN | 202254492 | U | 5/2012 |
| CN | 202304070 | U | 7/2012 |
| CN | 103003641 | A | 3/2013 |
| CN | 103282730 | A | 9/2013 |
| CN | 104359246 | A | 2/2015 |
| CN | 104697234 | A | 6/2015 |
| DE | 4303669 | C1 | 1/1994 |
| DE | 10029999 | A1 | 1/2002 |
| DE | 10321191 | A1 | 11/2003 |
| EP | 0005825 | A1 | 12/1979 |
| EP | 1236959 | A2 | 9/2002 |
| EP | 1731853 | A2 | 12/2006 |
| EP | 2068094 | A1 | 6/2009 |
| EP | 2077427 | A1 | 7/2009 |
| EP | 2175212 | A1 | 4/2010 |
| EP | 2224187 | A2 | 9/2010 |
| EP | 2504640 | A2 | 10/2012 |
| EP | 3032208 | A1 | 6/2016 |
| EP | 2718642 | B1 | 9/2016 |
| EP | 3098543 | A1 | 11/2016 |
| FR | 2844036 | A1 | 3/2004 |
| GB | 2164439 | A | 3/1986 |
| JP | H04316962 | A | 11/1992 |
| JP | H04320762 | A | 11/1992 |
| JP | 2001221517 | A | 8/2001 |
| JP | 2005249315 | A | 9/2005 |
| JP | 2009097786 | A | 5/2009 |
| JP | 2010151424 | A | 7/2010 |
| JP | 2014077579 | A | 5/2014 |
| KR | 100196779 | B1 | 6/1999 |
| KR | 20080006585 | U | 12/2008 |
| RU | 2368850 | C2 | 9/2009 |
| RU | 2415307 | C1 | 3/2011 |
| RU | 2555087 | C1 | 7/2015 |
| SU | 996805 | A1 | 2/1983 |

(56) References Cited

FOREIGN PATENT DOCUMENTS

| | | | |
|---|---|---|---|
| WO | 2012012488 | A1 | 1/2012 |
| WO | 2012012493 | A2 | 1/2012 |
| WO | 2012012501 | A2 | 1/2012 |
| WO | 2012168544 | A1 | 12/2012 |
| WO | 2014106030 | A1 | 7/2014 |

OTHER PUBLICATIONS

International Search Report for Application No. PCT/EP2016/065575 dated Oct. 13, 2016.
International Search Report for Application No. PCT/EP2016/074758 dated Jan. 17, 2017.
European Examination Report for Serial No. 16 781 477.1 dated Feb. 21, 2019.
Danish Search Report for Serial No. PA 2015 00644 dated May 17, 2016.
International Search Report for Application No. PCT/EP2016/074774 dated Jan. 9, 2017.
International Search Report for Application No. PCT/EP2016/074765 dated Jan. 9, 2017.
International Search Report for PCT Serial No. PCT/EP2018/057515 dated Jun. 20, 2018.
International Search Report for PCT Serial No. PCT/EP2015/064019 dated Dec. 14, 2015.
International Search Report for PCT Serial No. PCT/EP2015/073211 dated Jan. 20, 2016.
International Search Report for PCT Serial No. PCT/EP2015/073171 dated Jan. 20, 2016.
Chinese Office Action and English Translation for Serial No. 201580060854.1 dated Jan. 4, 2019.
Indian Office Action dated Jan. 27, 2020 for Appln. No. 201817003292.
Partial European Search Report for Serial No. 19201243.3 dated Feb. 24, 2020.
Japanese Office Action and English Translation for Serial No. 2018-506946 dated May 12, 2020.

* cited by examiner

VAPOUR COMPRESSION SYSTEM WITH AT LEAST TWO EVAPORATOR GROUPS

CROSS-REFERENCE TO RELATED APPLICATION

This application is a National Stage application of International Patent Application No. PCT/EP2016/065575, filed on Jul. 1, 2016, which claims priority to Danish Patent Application No. PA201500473, filed on Aug. 14, 2015, each of which is hereby incorporated by reference in its entirety.

FIELD OF THE INVENTION

The present invention relates to a vapour compression system comprising at least two evaporator groups. Each evaporator group comprises an ejector unit, and the ejector units are arranged in parallel between an outlet of a heat rejecting heat exchanger and an inlet of a receiver. The invention further relates to a method for controlling such a vapour compression system.

BACKGROUND OF THE INVENTION

Refrigeration systems normally comprise a compressor, a heat rejecting heat exchanger, e.g. in the form of a condenser or a gas cooler, an expansion device, e.g. in the form of an expansion valve, and an evaporator arranged in a refrigerant path. Refrigerant flowing in the refrigerant path is alternatingly compressed by the compressor and expanded by the expansion device. Heat exchange takes place in the heat rejecting heat exchanger and the evaporator in such a manner that heat is rejected from the refrigerant flowing through the heat rejecting heat exchanger, and heat is absorbed by the refrigerant flowing through the evaporator. Thereby the refrigeration system may be used for providing either heating or cooling.

In some vapour compression systems an ejector is arranged in a refrigerant path, at a position downstream relative to a heat rejecting heat exchanger. Thereby refrigerant leaving the heat rejecting heat exchanger is supplied to a primary inlet of the ejector. Refrigerant leaving an evaporator of the vapour compression system is supplied to a secondary inlet of the ejector.

An ejector is a type of pump which uses the Venturi effect to increase the pressure energy of fluid at a suction inlet (or secondary inlet) of the ejector by means of a motive fluid supplied to a motive inlet (or primary inlet) of the ejector. Thereby, arranging an ejector in the refrigerant path as described will cause the refrigerant to perform work, and thereby the power consumption of the vapour compression system is reduced as compared to the situation where no ejector is provided.

In some vapour compression systems, two or more separate evaporator groups are connected to the same compressor group and the same heat rejecting heat exchanger. In this case each evaporator group forms a separate refrigerant loop between the heat rejecting heat exchanger and the compressor group, and the evaporators of the various evaporator groups may be used for different purposes within the same facility. For instance, one evaporator group may be used for providing cooling for one or more cooling entities or display cases in a supermarket, while another evaporator group may be used for air condition purposes in the supermarket, e.g. in the room where the cooling entities or display cases are positioned and/or in adjacent rooms. Thereby the cooling for the cooling entities or display cases and the air conditioning of the room(s) are handled using only one vapour compression system, rather than using separate vapour compression systems, with separate outdoor units.

EP 2 504 640 B1 discloses an ejector refrigeration system comprising a compressor, a heat rejecting heat exchanger, first and second ejectors, first and second heat absorbing heat exchangers, and a separator. The ejectors are arranged in series in the sense that the secondary inlet of one of the ejectors is connected to the outlet of the other ejector.

SUMMARY

It is an object of embodiments of the invention to provide a vapour compression system comprising at least two evaporator groups, in which the energy efficiency during operation of the vapour compression system is improved as compared to prior art vapour compression systems.

It is a further object of embodiments of the invention to provide a vapour compression system comprising at least two evaporator groups, the vapour compression system being able to operate in a very stable manner.

It is an even further object of embodiments of the invention to provide a method for controlling a vapour compression system comprising at least two evaporator groups in an energy efficient manner.

It is an even further object of embodiments of the invention to provide a method for controlling a vapour compression system comprising at least two evaporator groups in a stable manner.

According to a first aspect the invention provides a vapour compression system comprising:

a compressor group comprising one or more compressors, a heat rejecting heat exchanger, a receiver, and at least two evaporator groups, each evaporator group comprising an ejector unit, at least one evaporator and a flow control device controlling a flow of refrigerant to the at least one evaporator, wherein an outlet of the heat rejecting heat exchanger is connected to a primary inlet of the ejector unit of each of the evaporator groups, an outlet of each ejector unit is connected to an inlet of the receiver, and an outlet of the at least one evaporator of each evaporator group is connected to a secondary inlet of the ejector unit of the corresponding evaporator group.

According to the first aspect the invention relates to a vapour compression system. In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc.

The vapour compression system comprises a compressor group comprising one or more compressors. For instance, the compressor group may comprise a single compressor, in which case this compressor may advantageously be a variable capacity compressor. As an alternative, the compressor group may comprise two or more compressors arranged in parallel. Thereby the capacity of the compressor group may be varied by switching the compressors on or off, and/or by varying the capacity of one or more of the compressors, if at least one of the compressors is a variable capacity compressor. All of the compressors may have an inlet connected to the same part of the refrigerant path of the vapour compression system, or the compressors may be connected to various parts of the refrigerant path. This will be described in further detail below.

The vapour compression system further comprises a heat rejecting heat exchanger arranged to receive compressed refrigerant from the compressor group. In the heat rejecting heat exchanger heat exchange takes place between the refrigerant flowing through the heat rejecting heat exchanger and a secondary fluid flow, in such a manner that heat is rejected from the refrigerant flowing through the heat rejecting heat exchanger to the fluid of the secondary fluid flow. The secondary fluid flow may be ambient air flowing across the heat rejecting heat exchanger or another kind of heat rejecting fluid, such as sea water or a fluid which is arranged to exchange heat with the ambient via another heat rejecting heat exchanger, or it may be a heat recovery fluid flow arranged to recover heat from the refrigerant. The heat rejecting heat exchanger may be in the form of a condenser, in which case refrigerant passing through the heat rejecting heat exchanger is at least partly condensed. As an alternative, the heat rejecting heat exchanger may be in the form of a gas cooler, in which case refrigerant passing through the heat rejecting heat exchanger is cooled, but remains in the gaseous phase, i.e. no phase change takes place.

In the receiver the refrigerant is separated into a liquid part and a gaseous part.

The vapour compression system further comprises at least two evaporator groups. In the present context the term 'evaporator group' should be interpreted to mean a part of the vapour compression system which comprises one or more evaporators, and arranged in such a manner that the evaporator groups are independent of each other, in the sense that pressures prevailing in one evaporator group are essentially independent of pressures prevailing in another evaporator group. The evaporator groups of the vapour compression system may therefore be used for different purposes. For instance, one evaporator group may be dedicated for providing cooling to a number of refrigeration entities or display cases in a supermarket, while another evaporator group may be dedicated for providing air conditioning for a part of the building accommodating the supermarket. Furthermore, two or more evaporator groups may be used for providing air condition for various parts of the building. However, all of the evaporator groups are connected to the same compressor group and the same heat rejecting heat exchanger, instead of providing separate vapour compression systems for the various purposes.

Each evaporator group comprises an ejector unit, at least one evaporator and a flow control device controlling a flow of refrigerant to the at least one evaporator. The ejector unit comprises one or more ejectors. Since the evaporator groups are provided with ejector units, the energy consumption of the vapour compression system can be minimised, as described above.

In the evaporators heat exchange takes place between the refrigerant and the ambient in such a manner that heat is absorbed by the refrigerant flowing through the evaporators, while the refrigerant is at least partly evaporated. Each evaporator group may comprise a single evaporator. As an alternative, at least one of the evaporator groups may comprise two or more evaporators, e.g. arranged fluidly in parallel. For instance, as described above, one of the evaporator groups may be used for providing cooling to a number of cooling entities or display cases of a supermarket. In this case, each cooling entity or display case may be provided with a separate evaporator, and each evaporator may advantageously be provided with a separate flow control device in order to allow the refrigerant flow to each evaporator to be controlled independently.

It is not ruled out that the vapour compression system comprises one or more further evaporator groups which are not provided with an ejector unit.

An outlet of the heat rejecting heat exchanger is connected to a primary inlet of the ejector unit of each of the evaporator groups. Thus, the refrigerant leaving the heat rejecting heat exchanger is distributed among the evaporator groups, via the primary inlets of the ejector units.

An outlet of the ejector unit of each evaporator group is connected to an inlet of the receiver. Thus, the refrigerant flowing through the respective ejector units is collected in the receiver, where it is separated into a liquid part and a gaseous part, as described above.

Finally, an outlet of the evaporator(s) of each evaporator group is connected to a secondary inlet of the ejector unit of the corresponding evaporator group. Thus, the ejector unit of a given evaporator group sucks refrigerant from the evaporator(s) of that evaporator group, but not from the evaporator(s) of any of the other evaporator group(s). This is an advantage because this allows each of the evaporator groups to be controlled in an energy efficient manner, substantially independent of the control of the other evaporator group(s). For instance, each evaporator group can be controlled in a manner which allows the potential capacity of the ejector unit to be utilised to the greatest possible extent. Furthermore, this allows the vapour compression system to be operated in a very stable manner.

In summary, refrigerant flowing in the vapour compression system is alternatingly compressed by the compressor(s) of the compressor unit and expanded by the ejectors of the ejector units, while heat exchange takes place in the heat rejecting heat exchanger and the evaporators of the evaporator units.

An inlet of the compressor group may be connected to a gaseous outlet of the receiver, and the flow control device of each evaporator group may be connected to a liquid outlet of the receiver. Thereby the gaseous part of the refrigerant in the receiver is supplied directly to the compressors, while the liquid part of the refrigerant in the receiver is supplied to the evaporators of the evaporator groups, via the flow control devices, i.e. the liquid part of the refrigerant is evaporated by means of the evaporators. In the case that at least one of the flow control devices is an expansion device, it is thereby avoided that the gaseous part of the refrigerant in the receiver undergoes expansion in the expansion device(s), and it is therefore supplied to the compressor group at a higher pressure level. Thereby the energy required by the compressors in order to compress the refrigerant is reduced, and the energy consumption of the vapour compression system is accordingly reduced.

In this case the compressor group may comprise one or more main compressors and one or more receiver compressors, the main compressor(s) being connected to the outlet of the evaporator(s) of at least one evaporator group, and the receiver compressor(s) being connected to the gaseous outlet of the receiver. According to this embodiment, the compressor group comprises one or more compressors which are dedicated to compressing refrigerant received from the outlet of one or more evaporators, i.e. the main compressor(s), and one or more compressors which are dedicated to compressing refrigerant received from the gaseous outlet of the receiver, i.e. the receiver compressor(s). The main compressor(s) and the receiver compressor(s) are operated independently of each other. By appropriately controlling the compressors, it can be determined how large a fraction of the refrigerant being compressed by the compressor group originates from the gaseous outlet of the receiver, and how large a fraction originates from the outlet(s) of the evaporator(s).

As an alternative, all of the compressors of the compressor group may be connected to the gaseous outlet of the receiver, as well as to the outlet of one or more evaporators, i.e. all of the compressors of the compressor group may act as a 'main compressor' or as a 'receiver compressor'. This allows the total available compressor capacity of the compressor group to be shifted between 'main compressor capacity' and 'receiver compressor capacity', according to the current requirements. This may, e.g., be obtained by controlling valves, such as three way valves, arranged at the inlet of each compressor, in an appropriate manner.

According to the embodiment described above, the outlet(s) of the evaporator(s) of at least one of the evaporator groups is/are connected to the inlet of the compressor group as well as to the secondary inlet of the corresponding ejector unit. For these evaporator groups it is possible to control how large a fraction of the refrigerant leaving the evaporator(s) is supplied to the compressor group, and how large a fraction is supplied to the secondary inlet of the corresponding ejector unit. It is normally desirable to supply as large a fraction as possible to the secondary inlet of the ejector unit, because thereby the evaporator group is operated as energy efficient as possible.

It should be noted that it is not ruled out that the outlet(s) of the evaporator(s) of at least one of the evaporator groups is/are not connected to the inlet of the compressor group. Thus, for these evaporator groups, all of the refrigerant leaving the evaporator(s) is supplied to the secondary inlet of the corresponding ejector unit.

The ejector unit of at least one evaporator group may comprise two or more ejectors arranged in parallel. Thereby the capacity of the ejector unit can be adjusted by activating or deactivating the individual ejectors.

Alternatively or additionally, the ejector unit of at least one evaporator group may comprise at least one variable capacity ejector. Thereby the capacity of the ejector unit can be adjusted by adjusting the capacity of one or more of the ejectors.

The flow control device of at least one of the evaporator groups may be or comprise an expansion device, e.g. in the form of an expansion valve. In this case the refrigerant passing through the flow control device undergoes expansion before being supplied to the evaporator(s).

As an alternative, at least one of the flow control devices may be of another kind, such as an on/off valve. This may, e.g., be appropriate if the evaporator(s) is/are in the form of plate heat exchanger(s), such as liquid-liquid heat exchanger(s). In this case the evaporator group may be used for providing air condition for a part of the building which is arranged remotely with respect to the compressor group and the heat rejecting heat exchanger.

According to a second aspect the invention provides a method for controlling a vapour compression system according to the first aspect of the invention, the method comprising the steps of:

obtaining a pressure of refrigerant leaving the heat rejecting heat exchanger, for at least one evaporator group, obtaining a value for an operating parameter related to that evaporator group, and controlling the ejector units in accordance with the obtained pressure of refrigerant leaving the heat rejecting heat exchanger and/or in accordance with the obtained operating parameter(s).

It should be noted that a person skilled in the art would readily recognise that any feature described in combination with the first aspect of the invention could also be combined with the second aspect of the invention, and vice versa.

The vapour compression system being controlled by means of the method according to the second aspect of the invention is a vapour compression system according to the first aspect of the invention. The remarks set forth above are therefore equally applicable here.

According to the method of the second aspect of the invention, a pressure of refrigerant leaving the heat rejecting heat exchanger is initially obtained. This may, e.g., include measuring the pressure directly, or it may include deriving the pressure from one or more other measured parameters. The pressure of the refrigerant leaving the heat rejecting heat exchanger is dependent on ambient conditions, such as the outdoor temperature and the temperature of a secondary fluid flow across the heat rejecting heat exchanger. Such ambient conditions have an impact on how the vapour compression system must be controlled in order to operate in an energy efficient manner, and it is desirable to maintain this pressure at a level which is appropriate under the given circumstances. Furthermore, since the primary inlet of the ejector unit of each of the evaporator groups is connected to the outlet of the heat rejecting heat exchanger, the pressure of refrigerant leaving the heat rejecting heat exchanger is also the pressure of refrigerant being supplied to the primary inlets of the ejector units.

Furthermore, for at least one evaporator group, a value for an operating parameter related to that evaporator group is obtained. As mentioned above, the evaporator groups can be controlled independently of each other, and therefore an operating parameter related to one evaporator group may have no impact on the operation of the other evaporator group(s).

Finally, the ejector units are controlled in accordance with the obtained pressure of refrigerant leaving the heat rejecting heat exchanger and/or in accordance with the obtained operating parameter(s). Thereby it can be ensured that each evaporator group is controlled in an energy efficient and stable manner, while it is ensured that the entire vapour compression system is controlled in an energy efficient and stable manner.

Controlling one of the ejector units could, e.g., include adjusting one or more variable parameters of the ejector unit. For instance, an opening degree of the primary inlet of the ejector unit, and thereby the motive flow of the ejector unit, could be adjusted. In the case that the ejector unit comprises two or more ejectors arranged fluidly in parallel, this could be obtained by opening or closing primary inlets of the individual ejectors of the ejector unit. Alternatively, the opening degree of the primary inlet may be adjustable by moving a valve element, e.g. a conical valve element, relative to a valve seat.

Alternatively or additionally, an opening degree of the secondary inlet of the ejector unit, and thereby the secondary flow of the ejector unit, could be adjusted, e.g. in a manner similar to the one described above with respect to the primary inlet.

Alternatively or additionally, the dimensions and/or geometry of a mixing zone defined by the ejector unit could be adjusted, and/or the length of a diffuser of the ejector unit could be adjusted.

The various adjustments described above all result in an adjustment of the operating range of the ejector unit.

The step of controlling the ejector units may comprise:

controlling at least one of the ejector units in accordance with the obtained pressure of refrigerant leaving the heat rejecting heat exchanger, and controlling at least one of the ejector units in accordance with an obtained operating parameter related to the corresponding evaporator group.

According to this embodiment, the evaporator groups are controlled completely independently of each other. For instance, in the case that the vapour compression system comprises exactly two evaporator groups, one of the evaporator groups may be controlled purely on the basis of the pressure of refrigerant leaving the heat rejecting heat exchanger, and the other evaporator group may be controlled purely on the basis of the operating parameter related to that evaporator group. Accordingly, the first evaporator group is controlled in such a manner that an appropriate pressure is maintained at the outlet of the heat rejecting heat exchanger, thereby ensuring that the vapour compression system as such is operated in an energy efficient and stable manner. Simultaneously, the second evaporator group is controlled in such a manner that this evaporator group is operated in an energy efficient and stable manner.

The method may further comprise the step of obtaining a temperature of refrigerant leaving the heat rejecting heat exchanger and/or a temperature of a secondary fluid flowing across the heat rejecting heat exchanger, and the step of controlling at least one of the ejector units in accordance with the obtained pressure of refrigerant leaving the heat rejecting heat exchanger may comprise the steps of:

calculating a reference pressure value on the basis of the obtained temperature, comparing the calculated reference pressure value to the obtained pressure, and operating the ejector unit(s) on the basis of the comparison.

The calculated reference pressure value corresponds to a pressure level of the refrigerant leaving the heat rejecting heat exchanger, which is appropriate under the given operating condition, notably given the current temperature of the refrigerant leaving the heat rejecting heat exchanger and/or of the ambient temperature. The reference pressure is then compared to the obtained pressure of refrigerant leaving the heat rejecting heat exchanger, i.e. to the pressure which is actually prevailing in the refrigerant leaving the heat rejecting heat exchanger, and the ejector unit(s) are operated based on the comparison. It is desirable that the actual pressure is equal to the reference pressure value, because the reference pressure value represents the optimal pressure under the given circumstances. Accordingly, the ejector unit(s) is/are operated in a manner which ensures that the pressure of the refrigerant leaving the heat rejecting heat exchanger approaches the calculated reference pressure value in the case that the comparison reveals that there is a mismatch between the calculated reference pressure value and the obtained pressure.

According to an alternative embodiment, the step of controlling the ejector units may comprise the steps of:

determining whether the total capacity of the ejector units needs to be increased, decreased or maintained, based on the obtained pressure of refrigerant leaving the heat rejecting heat exchanger, in the case that the total capacity of the ejector units needs to be increased or decreased, selecting at least one evaporator group, based on the obtained operating parameter(s), and increasing or decreasing the capacity of the ejector unit of the selected evaporator group(s).

According to this embodiment, the total capacity of the ejector units is controlled on the basis of the pressure of refrigerant leaving the heat rejecting heat exchanger, i.e. the total capacity of the ejector units is selected in such a manner that an appropriate pressure of refrigerant leaving the heat rejecting heat exchanger is maintained. However, how this capacity is distributed among the ejector units is controlled on the basis of the operating parameter(s) related to the individual evaporator groups.

Thus, the obtained pressure of refrigerant leaving the heat rejecting heat exchanger determines whether the total capacity of the ejector units needs to be increased or decreased, or whether it can be maintained at the current level. And if it is determined that the total capacity of the ejector units must be increased or decreased in order to obtain an appropriate pressure level of the refrigerant leaving the heat rejecting heat exchanger, then an appropriate evaporator group is selected, based on the obtained operating parameter(s). For instance, in the case that the total capacity of the ejector units needs to be increased, then the evaporator group which needs the additional ejector capacity may be selected. Similarly, in the case that total capacity of the ejector units needs to be decreased, then the evaporator group which needs the ejector capacity least may be selected. The ejector capacity of the ejector unit of the selected evaporator group is then adjusted appropriately.

The step of selecting at least one evaporator group may comprise the steps of:

comparing the obtained operating parameter(s) to corresponding reference value(s), in the case that the total capacity of the ejector units needs to be increased, selecting the evaporator group having the largest deviation between the operating parameter and the reference value, and in the case that the total capacity of the ejector units needs to be decreased, selecting the evaporator group having the smallest deviation between the operating parameter and the reference value.

The reference value of a given evaporator group represents a value of the operating parameter which ensures that this evaporator group is operating in an energy efficient and stable manner. Therefore it is desirable that the obtained operating parameter is close to the reference value. Accordingly, if the deviation between the obtained operating parameter and the reference value is large, then the evaporator group is probably not operating in an optimal manner, and an increase in the ejector capacity of the ejector unit of the evaporator group may be required in order to improve the operation of the evaporator group. It is therefore appropriate to select such an evaporator group if an increase in the total ejector capacity is required.

On the other hand, if the deviation between the obtained operating parameter and the reference value is small, then the evaporator group is probably operating in an optimal manner. A decrease in the ejector capacity of the ejector unit of the evaporator group will therefore result in the evaporator group being operated in a less energy efficient manner. However, since the evaporator group is operating close to optimally, it will probably still be operating within an acceptable range, even if the ejector capacity is decreased. It is therefore appropriate to select such an evaporator group if a decrease in the total ejector capacity is required.

The method may further comprise the step of adjusting a pressure prevailing inside the receiver in the case that the deviation between the obtained operating parameter and the reference value exceeds a predefined threshold value for one or more evaporator groups.

In the case that several evaporator groups have operating parameters which deviate significantly from the corresponding reference values, then the vapour compression system as such may not be operating an in appropriate manner. Therefore, in this case it may be desirable to adjust other parameters than the ejector capacity of the ejector units, in order to obtain that operation of the vapour compression system as such is improved. For instance, the pressure prevailing inside the receiver may be adjusted in this case.

The method may further comprise the step of increasing the capacity of the ejector unit of a first evaporator group and decreasing the capacity of the ejector unit of a second evaporator group, in the case that the deviation between the obtained operating parameter and the reference value for the first evaporator group is significantly larger than the deviation between the obtained operating parameter and the reference value of the second evaporator group.

According to this embodiment, the distribution of the total ejector capacity among the ejector units of the various evaporator groups can be shifted in the case that it turns out that some of the evaporator groups are more in need of the ejector capacity than others. This may be done, even if an increase or a decrease in the total ejector capacity is not required. Furthermore, it can thereby be ensured that the total available ejector capacity is utilised to the greatest possible extent.

The operating parameter for at least one evaporator group may be a pressure prevailing inside the evaporator(s) of the evaporator group.

Alternatively or additionally, the operating parameter for at least one evaporator group may be a temperature of a secondary fluid medium flowing across the evaporator(s) of the evaporator group.

Alternatively or additionally, the operating parameter of at least one evaporator group may be a parameter reflecting a fraction of refrigerant flowing through the evaporator(s) of the evaporator group, which is not evaporated.

The operating parameters mentioned above are all indicative of whether or not the corresponding evaporator group is operating in an energy efficient manner.

BRIEF DESCRIPTION OF THE DRAWINGS

The invention will now be described in further detail with reference to the accompanying drawings in which.

DETAILED DESCRIPTION

Figure 1:
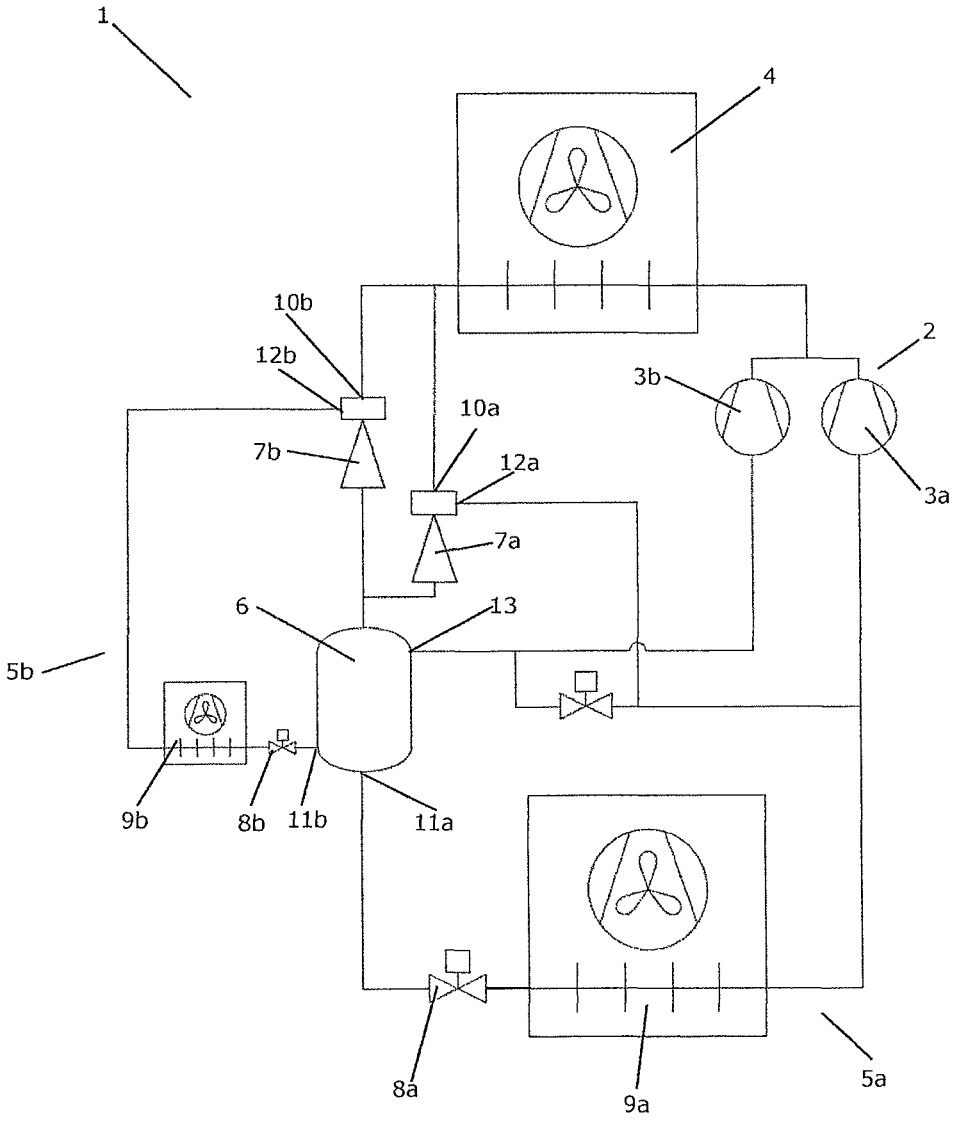
FIGS. 1-6 are diagrammatic views of vapour compression systems according to various embodiments of the invention.

FIG. 1 is a diagrammatic view of a vapour compression system 1 according to a first embodiment of the invention. The vapour compression system 1 comprises a compressor group 2 comprising a number of compressors 3, two of which are shown, and a heat rejecting heat exchanger 4. The vapour compression system 1 further comprises two evaporator groups 5*a*, 5*b*. The first evaporator group 5*a* is arranged to provide cooling for a number of cooling entities or display cases, and the second evaporator group 5*b* is arranged to provide air condition for one or more rooms at the facility where the cooling entities or display cases are positioned. The vapour compression system 1 further comprises a receiver 6.

The first evaporator group 5*a* comprises a first ejector unit 7*a*, a flow control device in the form of a first expansion valve 8*a*, and a first evaporator 9*a*. It should be noted that, even though the first evaporator 9*a* is shown as a single evaporator, it could in fact be two or more evaporators, arranged fluidly in parallel, each evaporator being arranged to provide cooling for a specific cooling entity or display case. In this case, each evaporator may be provided with a separate flow control valve, e.g. in the form of an expansion valve, controlling the flow of refrigerant to the evaporator.

Similarly, the second evaporator group 5*b* comprises a second ejector unit 7*b*, a flow control device in the form of a second expansion valve 8*b*, and a second evaporator 9*b*. Also in this case, the second evaporator 9*b* could be two or more evaporators, each arranged to provide air conditioning for a separate room.

Refrigerant flowing in the vapour compression system 1 is compressed by means of the compressors 3 of the compressor group 2. The compressed refrigerant is supplied to the heat rejecting heat exchanger 4, where heat exchange takes place with the ambient in such a manner that heat is rejected from the refrigerant to the ambient. In the case that the heat rejecting heat exchanger 4 is in the form of a condenser, the refrigerant passing through the heat rejecting heat exchanger 4 is at least partly condensed. In the case that the heat rejecting heat exchanger 4 is in the form of a gas cooler, the refrigerant passing through the heat rejecting heat exchanger 4 is cooled, but no phase change takes place.

The refrigerant leaving the heat rejecting heat exchanger 4 is supplied to a primary inlet 10*a* of the first ejector unit 7*a* and to a primary inlet 10*b* of the second ejector unit 7*b*. Refrigerant leaving the ejector units 7*a*, 7*b* is supplied to the receiver 6, where the refrigerant is separated into a liquid part and a gaseous part. The liquid part of the refrigerant leaves the receiver 6 via liquid outlets 11*a*, 11*b*, and is supplied to the evaporator 9*a* of the first evaporator group 5*a*, via the first expansion valve 8*a*, as well as to the evaporator 9*b* of the second evaporator group 5*b*, via the second expansion valve 8*b*.

The refrigerant leaving the first evaporator 9*a* is supplied either to the compressor group 2 or to a secondary inlet 12*a* of the first ejector unit 7*a*. The part of the refrigerant which is supplied to the compressor group 2 is supplied to a dedicated main compressor 3*a* which can only receive refrigerant from the first evaporator 9*a*. It is desirable that as large a fraction as possible of the refrigerant leaving the first evaporator 9*a* is supplied to the secondary inlet 12*a* of the first ejector unit 7*a*, because thereby the first evaporator group 5*a* is operated as energy efficient as possible. In fact, under ideal operating conditions, the main compressor 3*a* should not be operating at all. However, the main compressor 3*a* can be switched on when operating conditions are such that the first ejector 7*a* is not capable of sucking all of the refrigerant leaving the first evaporator 9*a*.

All of the refrigerant leaving the second evaporator 9*b* is supplied to a secondary inlet 12*b* of the second ejector unit 7*b*. Thus, the outlet of the second evaporator 9*b* is not connected to the compressor group 2, and the refrigerant flow in the second evaporator group 5*b* is essentially determined by the ejector capacity of the second ejector unit 7*b*.

Thus, the secondary inlet 12*a* of the first ejector unit 7*a* only receives refrigerant from the first evaporator 9*a*, and the secondary inlet 12*b* of the second ejector unit 7*b* only receives refrigerant from the second evaporator 9*b*. Accordingly, the first evaporator group 5*a* and the second evaporator group 5*b* are independent of each other, and can be controlled independently of each other by controlling the ejector capacities of the respective ejector units 7*a*, 7*b*.

The gaseous part of the refrigerant in the receiver 6 is supplied to the compressor group 2, via a gaseous outlet 13 of the receiver 6. This refrigerant is supplied directly to a dedicated receiver compressor 3*b*. The refrigerant supplied from the gaseous outlet 13 of the receiver 6 to the receiver compressor 3*b* is at a pressure level which is higher than the pressure level of the refrigerant supplied from the first evaporator 9*a* to the main compressor 3*a*, because the refrigerant supplied from the gaseous outlet 13 of the receiver 6 does not undergo expansion in the first expansion valve 8*a*. Therefore, the energy required in order to compress the refrigerant received from the gaseous outlet 13 of the receiver 6 is lower than the energy required in order to compress the refrigerant received from the first evaporator 9*a*.

According to one embodiment, the ejector capacity of the first ejector unit 7*a* may be controlled on the basis of the pressure of refrigerant leaving the heat rejecting heat exchanger 4, and in order to ensure that the pressure is maintained at an appropriate level. In this case the ejector capacity of the second ejector 7*b* may be controlled on the basis of an operating parameter related to the second evaporator group 5*b*, e.g. a pressure prevailing inside the second evaporator 9*b*, a temperature of a secondary fluid flow across the second evaporator 9*b*, or a parameter reflecting how much of the refrigerant circulating in the second evaporator group 5*b* is actually evaporated or not evaporated when passing through the second evaporator 9*b*.

According to another embodiment, the pressure of refrigerant leaving the heat rejecting heat exchanger 4 may be used as a basis for determining whether the total ejector capacity of the ejector units 7*a*, 7*b* should be increased, decreased or maintained at the current level. If it is determined that the total ejector capacity should be increased or decreased, either the first evaporator group 5*a* or the second evaporator group 5*b* is selected, based on a measured operating parameter for each of the evaporator groups 5*a*, 5*b*, e.g. one of the operating parameters described above. In the case that the total ejector capacity should be increased, the evaporator group 5*a*, 5*b* being most in need of the additional ejector capacity is selected. Similarly, in the case that the total ejector capacity should be decreased, the evaporator group 5*a*, 5*b* which needs the ejector capacity least is selected. Finally, the ejector capacity of the ejector unit 7*a*, 7*b* of the selected evaporator group 5*a*, 5*b* is adjusted in order to provide the required increase or decrease of the total ejector capacity.

Figure 2:
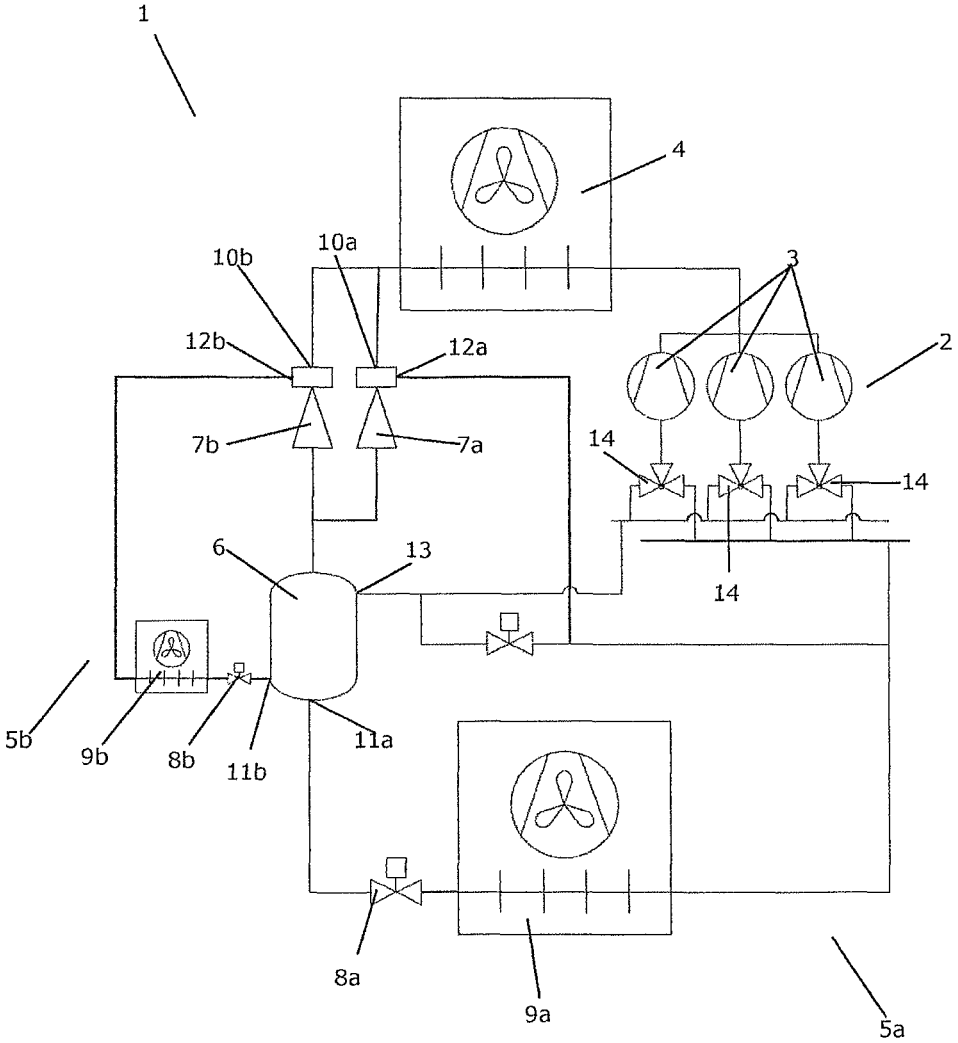

FIG. 2 is a diagrammatic view of a vapour compression system 1 according to a second embodiment of the invention. The vapour compression system 1 of FIG. 2 is similar to the vapour compression system 1 of FIG. 1, and it will therefore not be described in detail here. In the vapour compression system 1 of FIG. 2, the compressor group 2 comprises a number of compressors 3, three of which are shown. Each of the compressors 3 is provided with a three way valve 14, allowing each of the compressors 3 to be connected to either the outlet of the first evaporator 9*a* or the gaseous outlet 13 of the receiver 6. Thus, the compressors 3 are not dedicated 'main compressors' or dedicated 'receiver compressors', but each compressor 3 may operate as a 'main compressor' or as a receiver compressor'. This allows the total available compressor capacity of the compressor group 2 to be shifted between 'main compressor capacity' and 'receiver compressor capacity', according to the current requirements, by appropriately controlling the three way valves 14.

Figure 3:
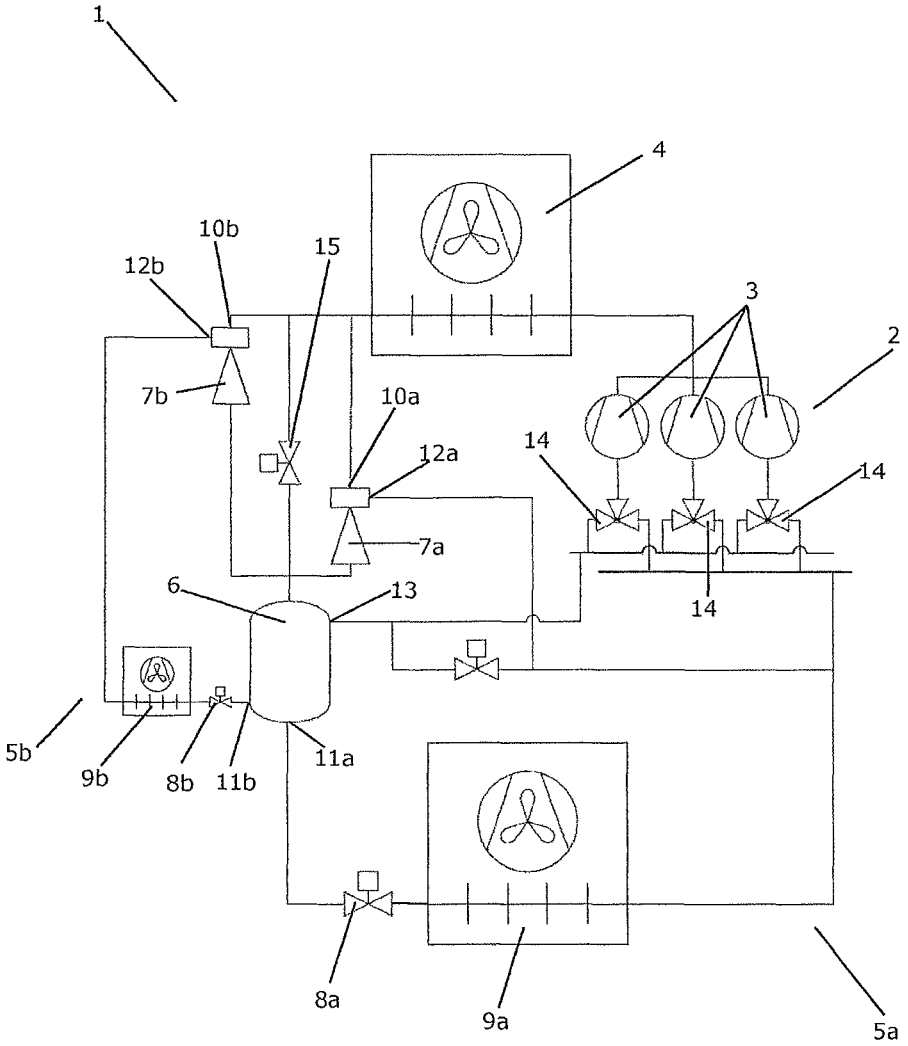

FIG. 3 is a diagrammatic view of a vapour compression system 1 according to a third embodiment of the invention. The vapour compression system 1 of FIG. 3 is very similar to the vapour compression system 1 of FIG. 2, and it will therefore not be described in detail here. The vapour compression system 1 of FIG. 3 further comprises a high pressure valve 15 arranged in a part of the refrigerant path which interconnects the outlet of the heat rejecting heat exchanger 4 and the receiver 6. Thus, the high pressure valve 15 is arranged fluidly in parallel with the ejector units 7*a*, 7*b*. In the vapour compression system 1 of FIG. 3 it is therefore possible to select whether refrigerant leaving the heat rejecting heat exchanger 4 should pass through one of the ejector units 7*a*, 7*b* or through the high pressure valve 15.

Figure 4:
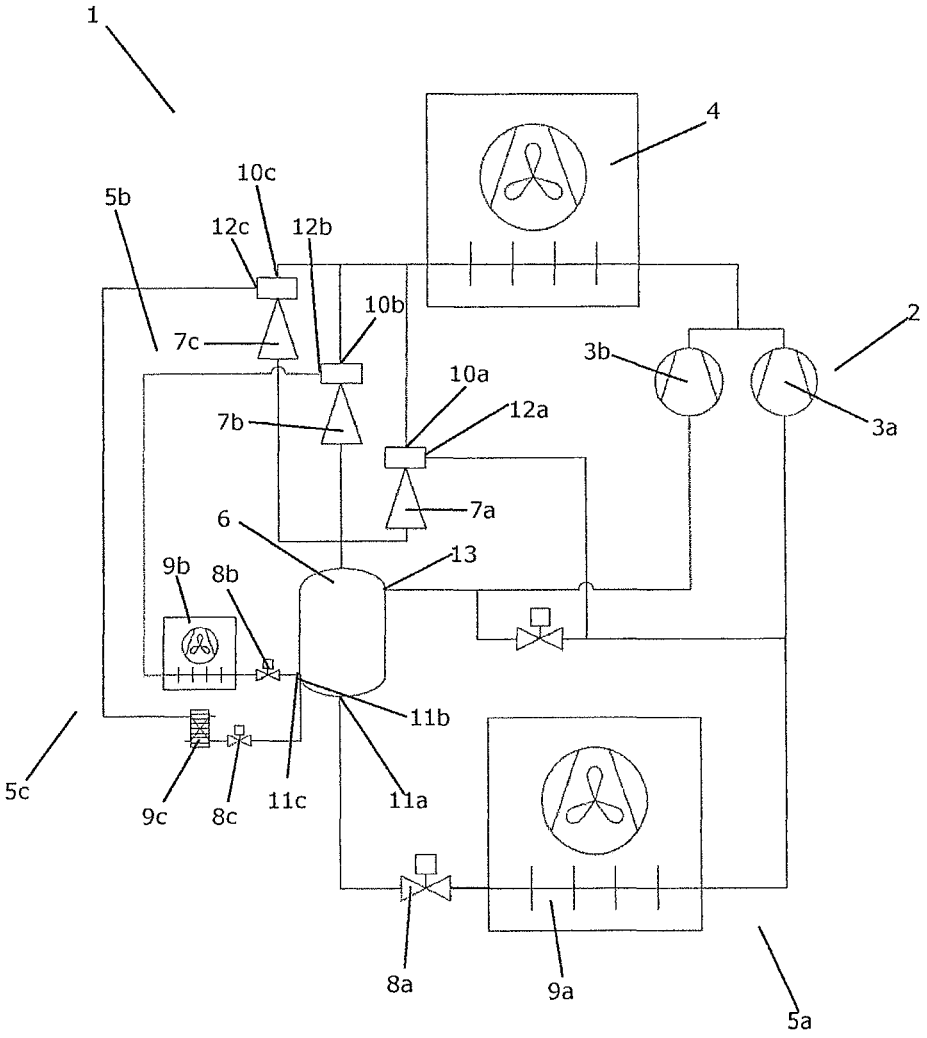

FIG. 4 is a diagrammatic view of a vapour compression system 1 according to a fourth embodiment of the invention. The vapour compression system 1 of FIG. 4 is very similar to the vapour compression system 1 of FIG. 1, and it will therefore not be described in detail here. The vapour compression system 1 of FIG. 4 comprises a third evaporator group 5*c*, comprising a third ejector unit 7*c*, a third expansion valve 8*c* and a third evaporator 9*c*.

The outlet of the third evaporator 9*c* is connected to the secondary inlet 12*c* of the third ejector unit 7*c* only, i.e. all of the refrigerant leaving the third evaporator 9*c* is supplied to the secondary inlet 12*c* of the third ejector unit 7*c*, similarly to the situation described above with reference to FIG. 1 and the second evaporator group 5*b*.

The third evaporator 9*c* is in the form of a plate heat exchanger, e.g. a liquid to liquid heat exchanger. Thus, the third evaporator group 5*c* may, e.g., be used for providing air condition to a part of the building which is arranged remotely with respect to the compressor group 2 and the heat rejecting heat exchanger 4.

Figure 5:
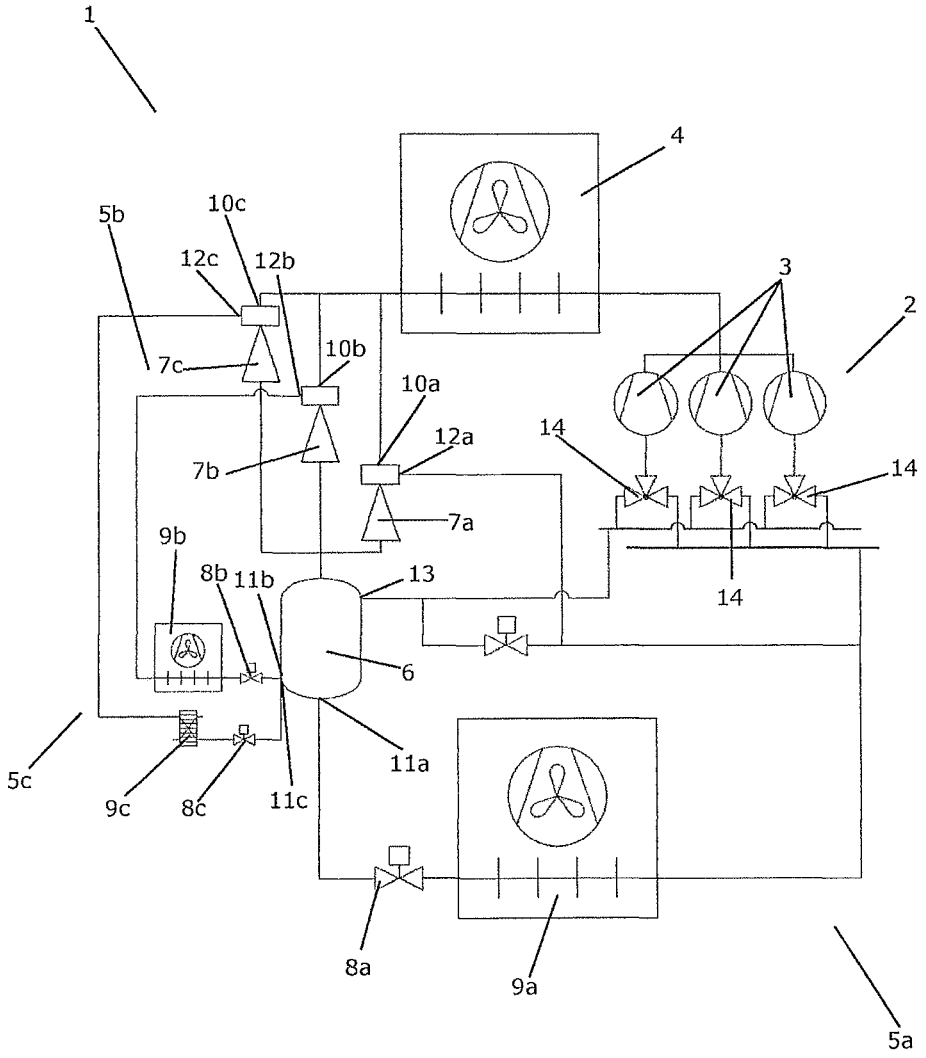

FIG. 5 is a diagrammatic view of a vapour compression system 1 according to a fifth embodiment of the invention. The vapour compression system 1 of FIG. 5 is very similar to the vapour compression system 1 of FIG. 4, and it will therefore not be described in detail here. In the vapour compression system 1 of FIG. 5 the compressors 3 of the compressor group 2 are all connected to the outlet of the first evaporator 9*a* as well as to the gaseous outlet 13 of the receiver 6, via respective three way valves 14. This has already been described above with reference to FIG. 2.

Figure 6:
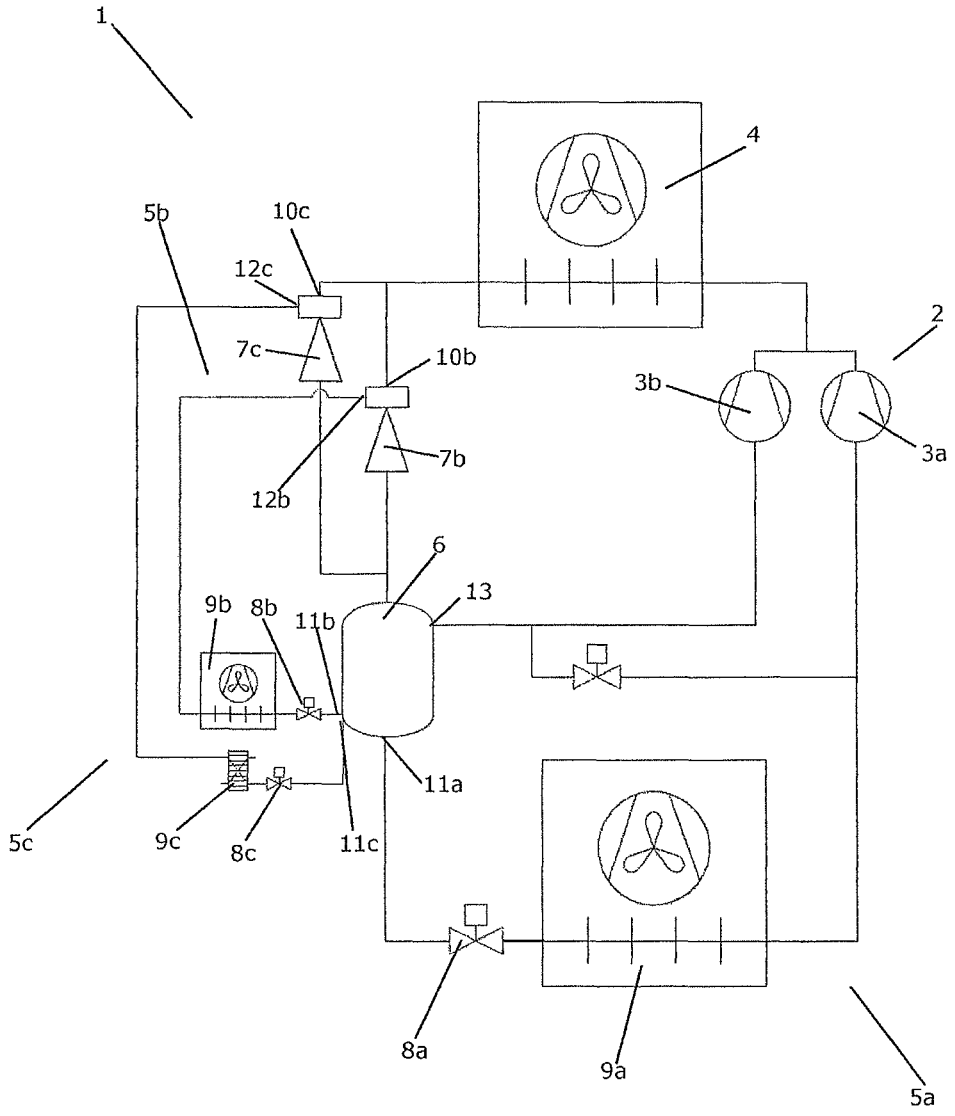

FIG. 6 is a diagrammatic view of a vapour compression system 1 according to a sixth embodiment of the invention. The vapour compression system 1 of FIG. 6 is very similar to the vapour compression system 1 of FIG. 4, in the sense that the vapour compression system 1 comprises three evaporator groups 5*a*, 5*b*, 5*c*. However, in the vapour compression system 1 of FIG. 6, only the second evaporator group 5*b* and the third evaporator group 5*c* are provided with an ejector unit 7*b*, 7*c*. The first evaporator group 5*a*, on the other hand, is not provided with an ejector unit. Accordingly, all of the refrigerant leaving the first evaporator 9*a* is supplied to the main compressor 3*a* of the compressor group 2, all of the refrigerant leaving the second evaporator 9*b* is supplied to the secondary inlet 12*b* of the second ejector unit 7*b*, and all of the refrigerant leaving the third evaporator 9*c* is supplied to the secondary inlet 12*c* of the third ejector unit 7*c*.

The vapour compression system 1 of FIG. 6 may, e.g., be suitable in situations where the total expansion capacity provided by the ejector units 7*b*, 7*c* can easily be utilised by the second evaporator group 5*b* and the third evaporator group 5*c*. In this case, adding a further ejector unit to the first evaporator group 5*a* will not improve the energy efficiency of the vapour compression system 1. Alternatively, the vapour compression system 1 of FIG. 6 may, e.g., be suitable in situations where the evaporating temperature of the first evaporator 9*a* is so low that an ejector unit arranged in the first evaporator group 5*a* will not be capable of lifting the pressure of the refrigerant leaving the first evaporator 9*a*.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method for controlling a vapour compression system comprising a compressor group comprising one or more compressors, a heat rejecting heat exchanger, a receiver, and at least two evaporator groups, each evaporator group comprising an ejector unit, at least one evaporator and a flow control device controlling a flow of refrigerant to the at least one evaporator, wherein an outlet of the heat rejecting heat exchanger is connected to a primary inlet of the ejector unit of each of the evaporator groups, an outlet of each ejector unit is connected to an inlet of the receiver, and an outlet of the at least one evaporator of each evaporator group is connected to a secondary inlet of the ejector unit of the corresponding evaporator group, the method comprising the steps of:

obtaining a pressure of a refrigerant leaving the heat rejecting heat exchanger, for at least one evaporator group, obtaining a value for an operating parameter related to that at least one evaporator group, and controlling at least one ejector unit of the at least two evaporator groups in accordance with the obtained pressure of the refrigerant leaving the heat rejecting heat exchanger or in accordance with the obtained value for the operating parameter, wherein the operating parameter of the at least one evaporator group of the least two evaporator groups is a parameter reflecting a quantity of refrigerant flowing through the at least one evaporator of the at least one evaporator group, which is not evaporated.

2. The method according to claim 1, wherein the step of controlling the at least one ejector unit comprises:

controlling a first ejector unit of a first evaporator group of the at least two evaporator groups in accordance with the obtained pressure of the refrigerant leaving the heat rejecting heat exchanger, and controlling a second ejector unit of a second evaporator group of the at least two evaporator groups in accordance with the obtained value for the operating parameter related to the at least one evaporator group.

3. The method according to claim 2, further comprising the step of obtaining a temperature of refrigerant leaving the heat rejecting heat exchanger, and wherein the step of controlling the first ejector unit in accordance with the obtained pressure of the refrigerant leaving the heat rejecting heat exchanger comprises the steps of:

calculating a reference pressure value on the basis of the obtained temperature, comparing the calculated reference pressure value to the obtained pressure, and operating the first ejector unit on the basis of the comparison.

4. The method according to claim 1, wherein the step of controlling the at least one ejector unit comprises the steps of:

determining whether the total capacity of the ejector units of the least two evaporator groups needs to be increased, decreased or maintained, based on the obtained pressure of refrigerant leaving the heat rejecting heat exchanger, when the total capacity of the ejector units of the least two evaporator groups needs to be increased or decreased, selecting at least one evaporator group of the least two evaporator groups, based on the obtained value for the operating parameter, and increasing or decreasing the capacity of the ejector unit of the selected at least one evaporator group.

5. The method according to claim 4, wherein the step of selecting at least one evaporator group of the least two evaporator groups comprises the steps of:

comparing the obtained value for the operating parameter to a corresponding reference value, when the total capacity of the ejector units of the least two evaporator groups needs to be increased, selecting the evaporator group of the least two evaporator groups having the largest deviation between the obtained value for the operating parameter and the reference value, and when the total capacity of the ejector units of the least two evaporator groups needs to be decreased, selecting the evaporator group of the least two evaporator groups having the smallest deviation between the obtained value for the operating parameter and the reference value.

6. The method according to claim 5, further comprising the step of adjusting a pressure prevailing inside the receiver when the deviation between the obtained operating parameter and the reference value exceeds a predefined threshold value for one or more evaporator groups of the least two evaporator groups.

7. The method according to claim 5, further comprising the step of increasing the capacity of the ejector unit of a first evaporator group of the least two evaporator groups and decreasing the capacity of the ejector unit of a second evaporator group of the least two evaporator groups, when the deviation between the obtained operating parameter and the reference value for the first evaporator group is significantly larger than the deviation between the obtained operating parameter and the reference value of the second evaporator group.

8. The method according to claim 1, wherein the operating parameter for the at least one evaporator group of the least two evaporator groups includes a pressure prevailing inside the at least one evaporator of the at least one evaporator group.

9. The method according to claim 1, wherein the operating parameter for the at least one evaporator group of the least two evaporator groups includes a temperature of a secondary fluid medium flowing across the at least one evaporator of the at least one evaporator group.

10. A method for controlling a vapour compression system comprising a compressor group comprising one or more compressors, a heat rejecting heat exchanger, a receiver, and at least two evaporator groups, each evaporator group comprising an ejector unit, at least one evaporator and a flow control device controlling a flow of refrigerant to the at least one evaporator, wherein an outlet of the heat rejecting heat exchanger is connected to a primary inlet of the ejector unit of each of the evaporator groups, an outlet of each ejector unit is connected to an inlet of the receiver, and an outlet of the at least one evaporator of each evaporator group is connected to a secondary inlet of the ejector unit of the corresponding evaporator group, the method comprising the steps of:

obtaining a pressure of a refrigerant leaving the heat rejecting heat exchanger, for at least one evaporator group, obtaining a value for an operating parameter related to that at least one evaporator group, and controlling at least one ejector unit of the at least two evaporator groups in accordance with the obtained pressure of the refrigerant leaving the heat rejecting heat exchanger or in accordance with the obtained value for the operating parameter, wherein the step of controlling the at least one ejector unit comprises the steps of:

determining whether the total capacity of the ejector units of the least two evaporator groups needs to be increased, decreased or maintained, based on the obtained pressure of refrigerant leaving the heat rejecting heat exchanger, when the total capacity of the ejector units of the least two evaporator groups needs to be increased or decreased, selecting at least one evaporator group of the least two evaporator groups, based on the obtained value for the operating parameter, and increasing or decreasing the capacity of the ejector unit of the selected at least one evaporator group, and wherein the step of selecting at least one evaporator group of the least two evaporator groups comprises the steps of:

comparing the obtained value for the operating parameter to a corresponding reference value, when the total capacity of the ejector units of the least two evaporator groups needs to be increased, selecting the evaporator group of the least two evaporator groups having the largest deviation between the obtained value for the operating parameter and the reference value, and when the total capacity of the ejector units of the least two evaporator groups needs to be decreased, selecting the evaporator group of the least two evaporator groups having the smallest deviation between the obtained value for the operating parameter and the reference value.

11. The method according to claim 10, further comprising the step of adjusting a pressure prevailing inside the receiver when the deviation between the obtained operating parameter and the reference value exceeds a predefined threshold value for one or more evaporator groups of the least two evaporator groups.

12. The method according to claim 10, further comprising the step of increasing the capacity of the ejector unit of a first evaporator group of the least two evaporator groups and decreasing the capacity of the ejector unit of a second evaporator group of the least two evaporator groups, when the deviation between the obtained operating parameter and the reference value for the first evaporator group is significantly larger than the deviation between the obtained operating parameter and the reference value of the second evaporator group.

13. The method according to claim 10, wherein the step of controlling the at least one ejector unit comprises:

controlling a first ejector unit of a first evaporator group of the at least two evaporator groups in accordance with the obtained pressure of the refrigerant leaving the heat rejecting heat exchanger, and controlling a second ejector unit of a second evaporator group of the at least two evaporator groups in accordance with the obtained value for the operating parameter related to the at least one evaporator group.

14. The method according to claim 13, further comprising the step of obtaining a temperature of refrigerant leaving the heat rejecting heat exchanger, and wherein the step of controlling the first ejector unit in accordance with the obtained pressure of the refrigerant leaving the heat rejecting heat exchanger comprises the steps of:

calculating a reference pressure value on the basis of the obtained temperature, comparing the calculated reference pressure value to the obtained pressure, and operating the first ejector unit on the basis of the comparison.

15. The method according to claim 10, wherein the operating parameter for the at least one evaporator group of the least two evaporator groups is a pressure prevailing inside the at least one evaporator of the at least one evaporator group.

16. The method according to claim 10, wherein the operating parameter for the at least one evaporator group of the least two evaporator groups is a temperature of a secondary fluid medium flowing across the at least one evaporator of the at least one evaporator group.

* * * * *